United States Patent [19]

Ståhle

[11] Patent Number: 5,041,028

[45] Date of Patent: Aug. 20, 1991

[54] HAND TOOL FOR APPLYING A FORCE TO A WORKPIECE

[75] Inventor: Ragnar Ståhle, Uddevalla, Sweden

[73] Assignee: Fast Industriprodukter HB, Uddevalla, Sweden

[21] Appl. No.: 571,598

[22] PCT Filed: Feb. 14, 1989

[86] PCT No.: PCT/SE89/00063

§ 371 Date: Aug. 29, 1990

§ 102(e) Date: Aug. 29, 1990

[87] PCT Pub. No.: WO89/08009

PCT Pub. Date: Sep. 8, 1989

[30] Foreign Application Priority Data

Feb. 29, 1988 [SE] Sweden ..... 8800700

[51] Int. Cl.[5] ..... H01R 13/00

[52] U.S. Cl. ..... 439/822

[58] Field of Search ..... 439/822, 829, 832, 835

[56] References Cited

U.S. PATENT DOCUMENTS

| | | | |
|---|---|---|---|
| 1,301,347 | 4/1919 | Williams | 439/822 |
| 1,422,765 | 7/1922 | Johnson | 439/822 |
| 1,980,228 | 11/1934 | Rodgers | 439/822 |
| 2,714,198 | 7/1955 | Schloetzer | 439/822 |

*Primary Examiner*—Joseph H. McGlynn

*Attorney, Agent, or Firm*—Sughrue, Mion, Zinn, Macpeak and Seas

[57] ABSTRACT

A hand tool for lockably applying a squeezing or separating force to a workpiece. The tool comprises two legs (1,2) which can be pivoted relative to one another and which have first ends which are free and form two jaws (3,4) intended for co-action with the workpiece. The arms are connected together at a distance from the aforesaid ends, by means of a spring element (9). The tool is mainly characterized in that the spring element (9) has an effect which corresponds to that of a compressible pressure spring, and the legs (1,2) are rigid and intened to be pivoted relative to one another, in order to bring the jaws into contact with the workpiece (15) without appreciably compressing the spring element. Arranged between the spring element and the jaws is a locking arrangement (10,12,13) which is intended, subsequent to compressing the spring element (9) to a desired extent with the jaws (3,4) in contact with the workpiece (15) to releasably lock the position of a pivot means between the legs. This pivot means is located at a shorter distance from the jaws than from the action line of the spring element, so that the force exerted by the spring element will generate an amplified pressure force on the workpiece.

10 Claims, 10 Drawing Sheets

II
II
L1
L2
L3
C
C1

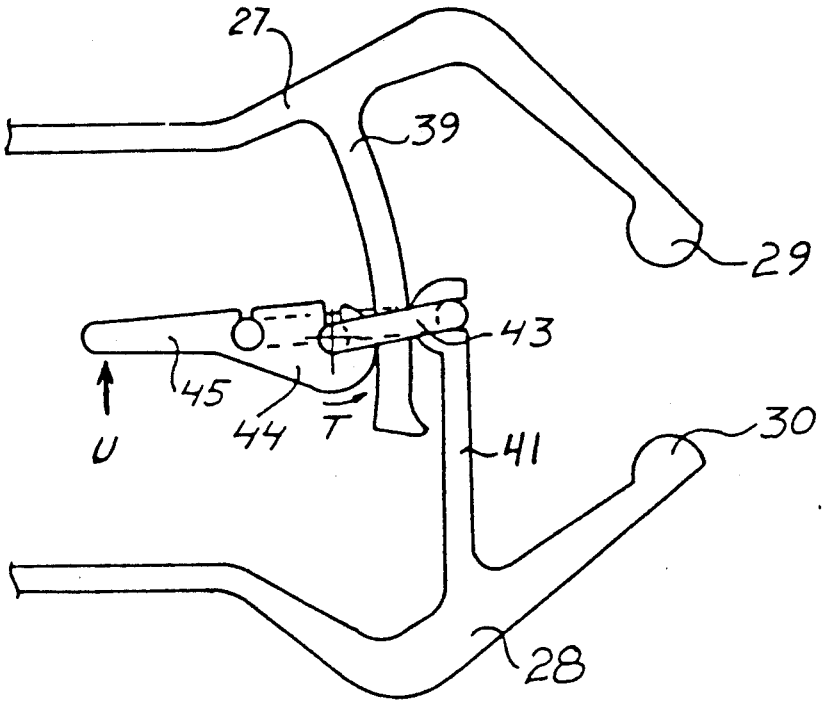
Fig 17
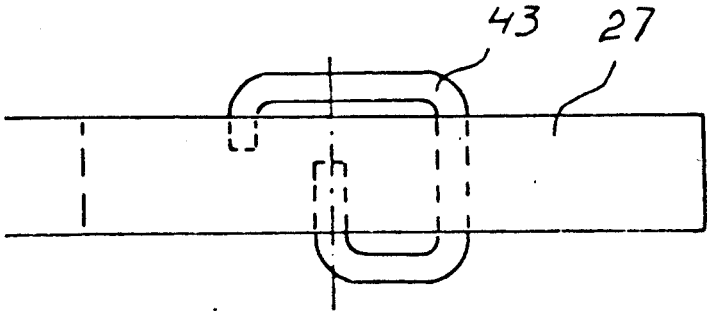

HAND TOOL FOR APPLYING A FORCE TO A WORKPIECE

The present invention relates to a hand tool which is intended for lockingly applying a squeezing or a separating force to a workpiece and which comprises two legs which can be pivoted relative to one another and the free ends of which form respective jaws intended for co-action with the workpiece, said jaws being mutually connected by means of a spring element at a distance from said ends. Such a hand tool may be intended for use as a contact clip or clamp for conducting an electric current and may find particular use as an earthing clamp in electric welding processes.

There are many instances when such clamps or clips are required, e.g. for the purpose of clamping or pressing workpieces together, or of fixating workpieces in desired positions. This applies, for instance, when gluing or welding workpieces together. In the case of electric welding, the clamp or clip will preferably also serve as an earthing clip for currents of high strengths.

Clamps or clips for this purpose, hereinafter referred to solely as clamps, should be easy to manipulate, preferably with one hand, should have a relatively wide working range, normally from 0 to 50 mm, and should be capable of exerting high clamping forces. Clamps intended for electric welding purposes must also be good electrical conductors.

Many types of clamps are available on the market.

One example of such clamps is the so-called crocodile clamp or simple tong constructions which have two mutually pivotable jaws and a spring located therebetween. These clamps are cheap to produce and are easy to use, but in use exert only small clamping forces, particularly when clamping thin objects.

Another form of clamping tool is found in tongs equipped with force amplifying mechanisms. These tools can be used relatively easily and generate high clamping forces, but are expensive to produce.

Another type of clamp is the screw clamp, in its various forms.

While generating high clamping forces, these clamps are relatively expensive and are relatively difficult to use.

The majority of the clamps mentioned above can be complemented with appropriate connecting devices which enable the clamps to be fitted to electrical cables. When used with electric welding processes, however, special measures must be taken at times, in view of the heavy currents to be conducted, for instance, the jaws must be made of an electrically conductive material and separate electrical connections must be arranged between the jaws, so as to achieve desired distribution of the currents. Furthermore, the springs must be insulated electrically, so as not to be damaged by resistive heating.

The U.S. Pat. No. 1,543,524, describes a battery clamp, or clip, which can be readily manufactured, simply by bending a one-piece leaf spring. In this case, the spring functions as a pivot and also as a tensioning spring clamp, and will also conduct current between the two legs. Since the clamp is made in one piece, there are no transition losses in the current path.

One disadvantage with this known clamp, however, is that if the cross-sectional area of the spring is increased, as will be necessary if the spring is to conduct heavy currents, the spring mass becomes unreasonably large to achieve the combination of an acceptable clamping effect and a reasonable gape size. The clamping effect also varies with the distance between the jaws and is greatest at maximum distance and reaches its lowest value at the smallest jaw gape.

The U.S. Pat. No. 1,474,434 describes another kind of battery clamp. This clamp can be locked around a battery terminal with the aid of a locking arm disposed between the legs of the clamp. The clamp is made of a springy material which enables the legs to be swung towards one another and which automatically restores the legs to their original position, when the locking arm is released. The clamping force is dependent on the force applied when fitting or applying the clamp, wherewith the clamping force can be reduced due to the fact that the legs are sprung along the whole of their lengths.

One object of the present invention is to provide an easily operated hand tool which can be used as a clamp, which can be produced rationally at low costs, and which will generate much higher clamping forces within a wider working range with regard to jaw gape than can be achieved in practice with known clamps of a similar kind. The tool will also apply a substantially constant clamping force over the whole working range and can be constructed for both a workpiece squeezing and a workpiece separating action.

Another object is to provide a clamp of the aforesaid kind which can be used as an electric contact clamp, for instance as an earthing clip for use with electric welding work, without risk of the clamping or squeezing function being impaired as a result of the passage of heavy currents through the clamp.

The invention is based on the realization that these objects can be achieved with the aid of a compressible pressure spring element which is compressed to a desired extent when fitting the clamp and the spring force of which is restored in the form of an amplified pressure force on the jaws of the legs when the force compressing the spring element is removed.

A hand tool of the kind described in the introduction and constructed in accordance with the invention is particularly characterized in that the spring element has an effect which corresonds to that of a compressible pressure spring; in that the legs are rigid and intended to be pivoted relative to one another so as to bring the jaws into contact with the workpiece without compressing the spring element to any appreciable extent; in that a locking device is arranged between the spring element and the jaws, said locking device being intended to lock releasably the position of a pivot between the legs subsequent to compressing the spring element to a desired extent with jaws in contact with the workpiece; and in that said pivot is located at a shorter distance from the jaws than from the action line of the spring element, so that the force exerted by the spring element will give rise to an amplified pressure force on the workpiece.

Such a hand tool can be constructed with desired transmission or amplification between sring force and pressure force, and consequently very large pressure forces can be generated with the aid of a pressure spring which can be readily compressed with the hand. The pressure force is also substantially independent of the prevailing jaw gape and is governed by the extent to which the spring is compressed. This enables the pressure force to be adjusted to a predetermined value, relatively accurately, with each application.

The spring element will preferably have the form of a pressure spring so constructed or arranged as to enable the legs to be pivoted relatively to one another, and the locking device will include a locking element which projects outwardly from a first of said legs and which is intended to co-act with a locking member on the other of said legs, so as to lock the legs in relation to one another, while forming a pivot therebetween.

In accordance with a particularly referred embodiment in which amplification or transmission of the spring force is high, the locking device comprises a locking arm which is pivotally attached at its forward end to said second leg, close to the jaw thereon, and which extends along the leg and is adapted to co-act with the locking element in a manner which enables the legs to be swung towards one another but which prevents swinging of the legs in the opposite direction unless a latching mechanism has been released. In this case, the locking arm is preferably spring-biassed in a direction towards said first leg and is provided with a groove or slot which receives the locking element, the groove and the locking element being so configured that the locking element is able to move freely in one direction in the slot but is latched against movement in the other direction unless the arm is swung slightly, against the action of said spring.

The locking element may also be provided with teeth or like serrations and adapted to co-act with pawl-like devices or, for instance, excentric mechanisms.

In the case of one embodiment of the inventive hand tool, preferred from the aspect of manufacture, the spring element comprises a compressible leaf spring which also functions as a pivot when the legs are pivoted into abutment with the workpiece. At least the spring element and said legs are preferably configured from a single piece of material, so as to form a one-piece structure. When the tool is to be used as a contact clip of clamp for conducting electric current, the tool will preferably be constructed from part of an extruded, rod-like profile section of a material having good electrically conductive properties, such as aluminium.

When the tool is constructed in accordance with the aforesaid embodiment, and includes a leaf spring, the leaf spring will, interalia, fulfil the following functions. It will hold the legs in a desired starting position, it will function as a guide and a pivot for pivotal movement of the legs towards and away from one another, it will function as a gripping part and a tensioning spring, and, in the case of electrically conductive clamps, will form a continuous current path of wide cross-sectional area.

The leaf spring will preferably include at least one part which projects in between the legs, wherewith the distance between the legs can be increased by pressing together the ends of the legs remote from the jaws.

The invention will now be described in more detail with reference to the accompanying drawings; in which FIG. 1 is a side view of a first embodiment of an inventive hand tool;

Figure 9:
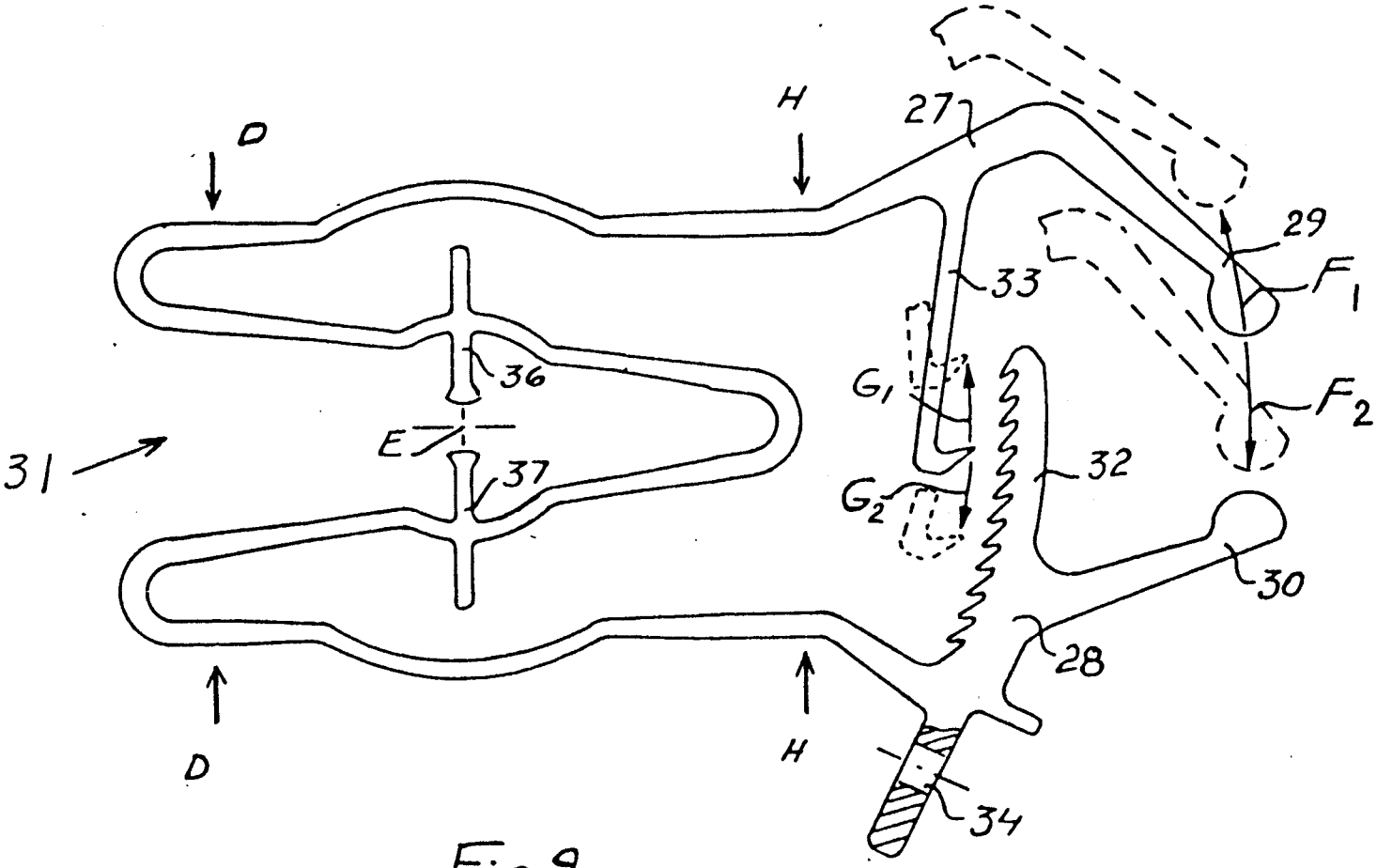
FIG. 9 is a side view of an embodiment of an inventive tool intended for use as an electric contact clamp.
Figure 14:
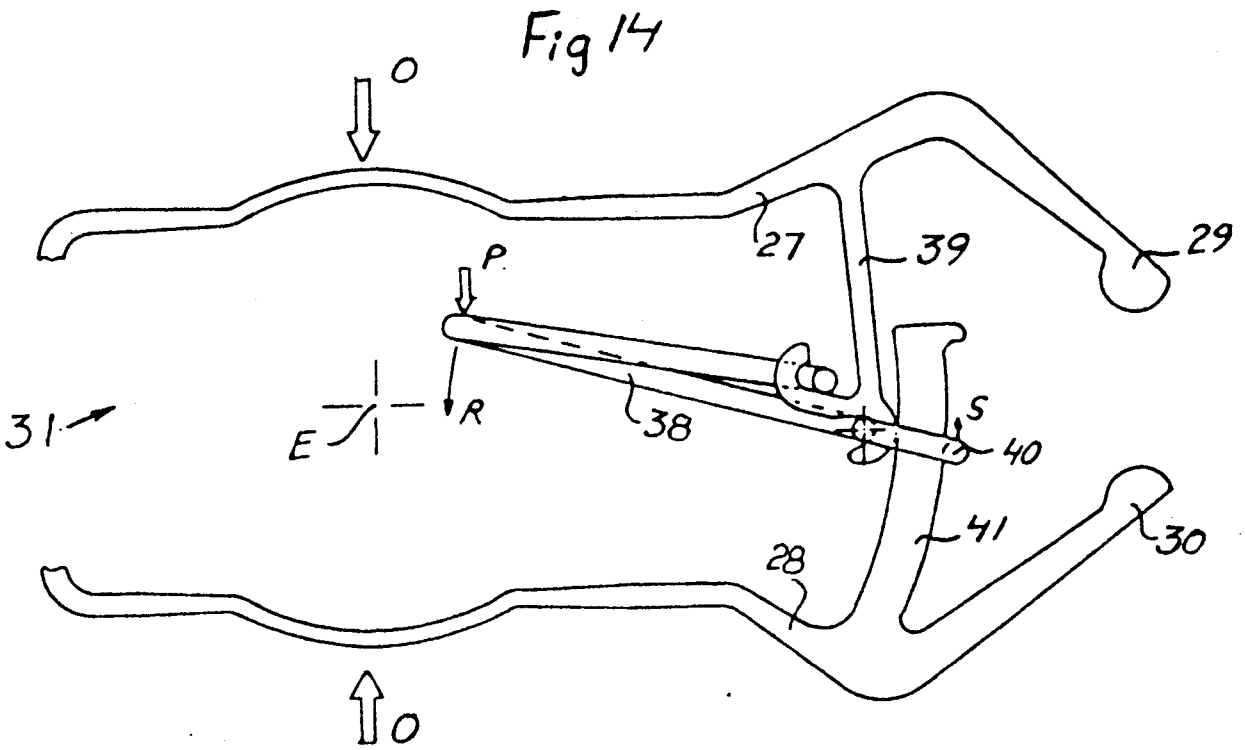
Figure 15:
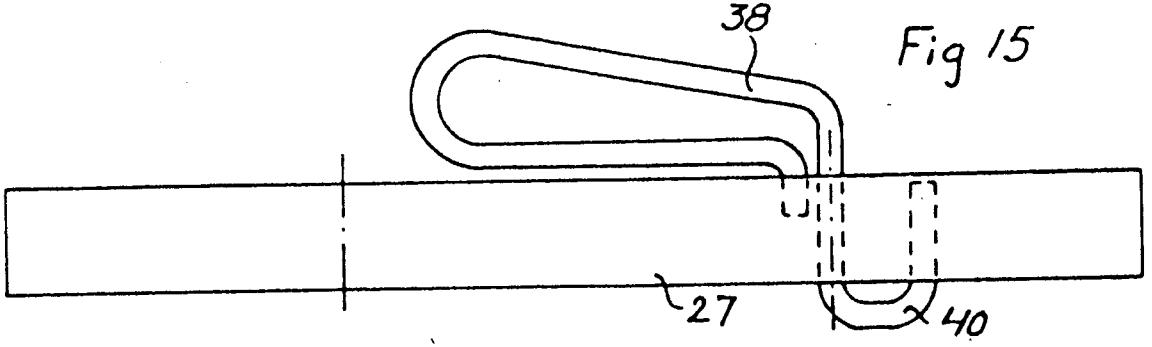

FIGS. 14 and 15 illustrate an alternative embodiment of the clamp shown in FIG. 9; and FIGS. 16 and 17 show an alternative embodiment of the clamp locking mechanism according to FIGS. 14 and 15.

Figures 1, 2, 4, 5A, 5B:
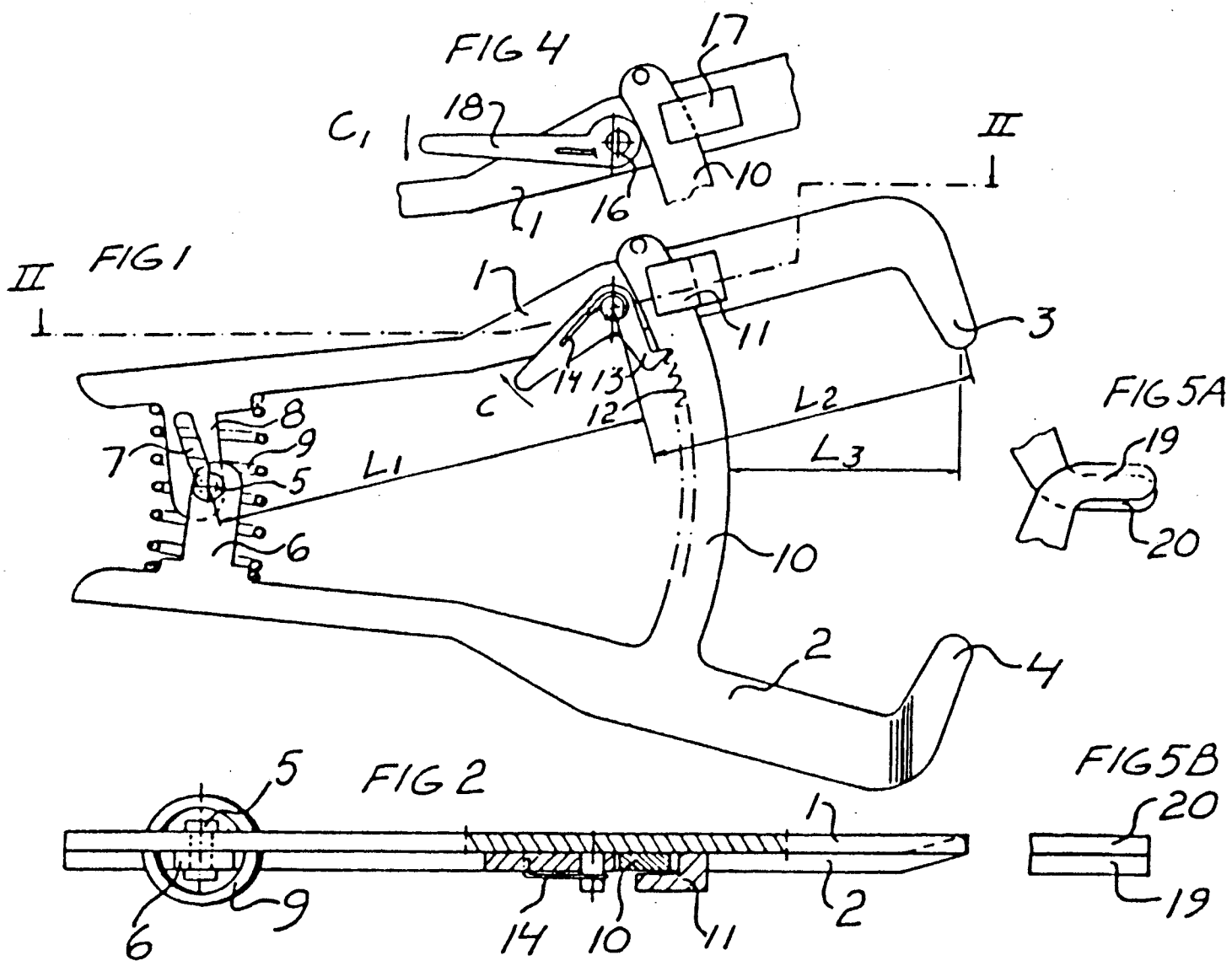
FIG. 2 is a view taken on the line II—II in FIG. 1.
FIG. 4 illustrates an alternative leg locking mechanism.
FIG. 5A and 5B illustrate an alternative embodiment of the tool jaws in two perpendicular projections.

The tool illustrated in FIGS. 1 and 2 includes two legs 1, 2 which can be pivoted relative to one another and the forward, free ends of which have the form of jaws 3, 4 which are intended to co-act with a workpiece. The rear parts of the legs 1 and 2 form a tool gripping part which can be held in the hand of a workman. In the case of the illustrated embodiment, the legs are pivotal relative to one another about a pivot pin 5 which is journaled in an outwardly projecting part 6 of the lower leg 2 and moves in a slot 7 located in a corresponding part 8 of the upper leg 1.

The legs 1 and 2 are urged in a direction away from one another by means of a bendable pressure spring 9, which is arranged around the parts 6 and 8. The spring 9, however, can be replaced with some other compressible spring element, for example a rubber element. A spring element which is not laterally flexible or bendable can also be used, depending upon the position of the pivot pin 5.

An arcuate locking element 10 curves outwards from the lower leg 2 in a direction towards the upper leg 1, as seen in FIG. 1. The locking element 10 is guided beneath a projection 11 mounted on the leg 1 and is provided with teeth 12 which co-act with a latching pawl 13 pivotally mounted on the leg 1. The pawl 13 is urged into engagement with the teeth 12 by a spring 14.

Figure 3:
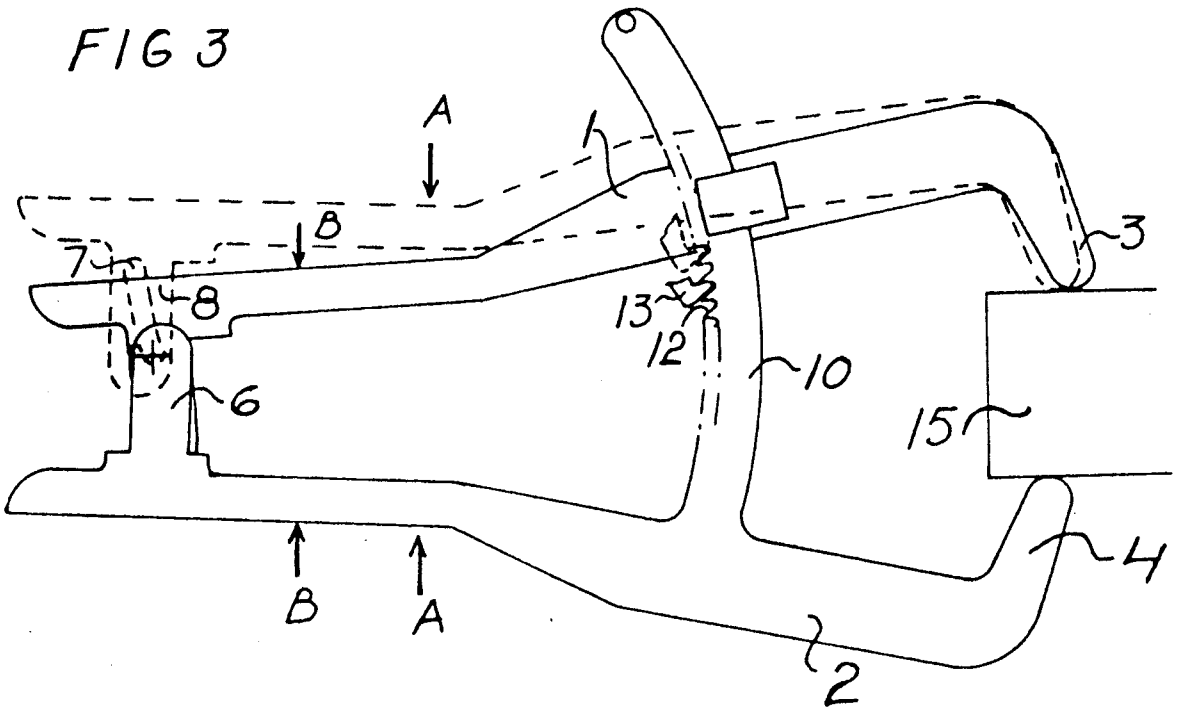
FIG. 3 illustrates the tool of FIG. 1 in engagement with a workpiece.

When using the tool illustrated in FIGS. 1 and 2 for pressing the jaws 3 and 4 against and locking said jaws onto a workpiece, there is first applied to legs 1 and 2 forces which act in the directions of arrows A in FIG. 3. These forces cause the legs to pivot relative to one another about the pivot point formed by the pivot pin 5, without appreciable compression of the spring 9, until the jaws engage the workpiece 15; see the broken-line position of the upper leg 1 in FIG. 3. The spring 9, the pivot pin 5 and large parts of the latching pawl 13 have been omitted from FIG. 3, for the sake of clarity.

The spring 9 is compressed subsequent to contact of the jaws 3 and 4 with the workpiece 15. This is affected most simply, by shifting the forces exerted by the hand on the legs 1 and 2 slightly rearwardly, so that said forces will act in the directions of the arrows B. The pivot pin 5 will therewith move up into engagement with the upper end of the slot 7, at the same time as the pawl 13 moves down the toothed section 12.

Subsequent to reaching maximum compression, or desired compression, of the spring 9, the forces acting externally on the legs 1 and 2 are removed, whereupon the spring 9 will endeavour to urge the legs 1 and 2 away from one another. Separation of the legs, however, is prevented because of the engagement of the pawl 13 with one of the teeth of the toothed section 12, this engagement point forming a pivot between the legs for the force exerted by the spring 9. Because the pivot point defined by this engagement of the pawl 13 lies closer to the jaws 3 and 4 than the action line of the spring 9, the force exerted by the spring, i.e. the earlier manually exerted force, will be applied to the workpiece 15 in the form of an amplified clamping force. When using the reference signs L1 and L2 shown in FIG. 1, this force transmission will be L1/L2. This force transmission is limited by the requirements placed on the depth of jaw gape L3 and acceptable tool length. A force transmission or amplification of three times the force applied can be readily achieved, however, in practice with a tool according to FIG. 1.

The tool is released, by applying a force on the latching pawl 13 in the direction of the arrow C in FIG. 1.

A tool of the kind described can be used to clamp workpieces which vary greatly in thickness. The tool can thus be used to clamp extremely thin workpieces, wherewith essentially the same clamping force can be achieved irrespective of thickness, since the clamping force is determined by compression of the spring 9 substantially irrespective of the distance between the jaws 3 and 4. The part 8 projecting from the leg 2 may be provided with a scale or graduations which translate compression of the spring into force units. Desired limitation of the clamping force can be achieved, for instance, with the aid of stop means located in the slot 7. It is not necessary to adapt the tool in respect of desired jaw gape, since this is achieved automatically as the legs are pivoted towards a workpiece.

FIG. 4 illustrates the use of a pivotal excentric 16 by means of which the locking element 10 can be pressured against a rigid support and guide shoulder 17 on the leg 1, so as to lock the legs 1 and 2 in desired positions relative to one another. The advantage with an embodiment according to FIG. 4 is that the legs can be locked together in selected positions irrespective of the pitch of the toothed section. The tool is released in this case by exerting a force in the direction of arrow $C_1$ on a level arm 18 connected to the excentric element.

FIGS. 5A and 5B illustrate an alternative embodimentt of the jaws 19, 20 of legs 1 and 2, which can be used if a separating force is required instead of a squeezing or clamping force on two surfaces.

Figure 6:
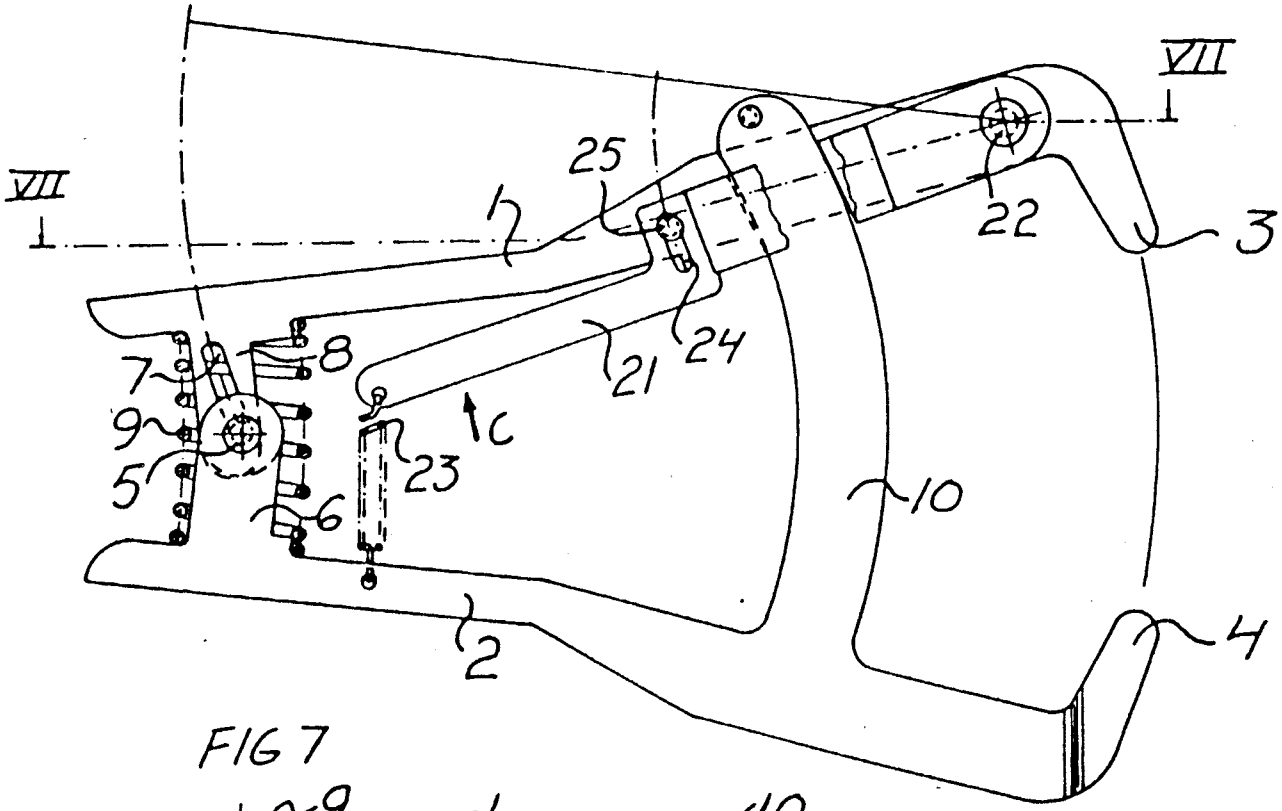
FIG. 6 illustrates an alternative embodiment of the tool illustrated in FIG. 1, this alternative embodiment engendering higher transmission or force amplification.
Figure 7:
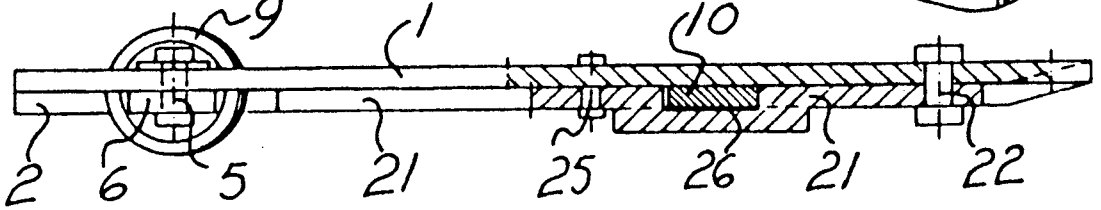
FIG. 7 is a view taken on the line VII—VII in FIG. 6.

FIGS. 6 and 7 illustrate an alternative embodiment of the aforedescribed hand tool, with which the spring force can be greatly amplified while retaining a reasonable gape depth, i.e. the measurement $L_3$ in FIG. 1. In the FIG. 6 embodiment, this can be achieved by locating the pivot about which the legs 1 and 2 pivot relative to one another, subsequent to the legs being locked by the locking mechanism, very close to the jaw of one leg. Those parts of the FIG. 6 embodiment which have direct correspondence with earlier figures are identified with the same reference signs, and the functions of these parts will not be described again in the following.

Locking of the upper leg 1 to be locking element 10 is effected by means of a locking arm 21, the forward end of which is pivotally mounted on the upper leg 1 close to the jaw 3 thereof, by means of a pivot pin 22. The locking arm 21 is biassed in a direction towards the lower leg 2, with the aid of a relatively weak spring 23. The locking arm 21 is also provided with a guide slot 24 which co-acts with a guide pin 25 rigidly mounted on the upper leg 4. For the purpose of locking arm 21 firmly to the locking element 10, the arm is provided with a slot or groove 26, the width of which is insignificantly greater than the width of the locking element 10. The legs 1 and 2 can therewith be pivoted freely towards one another, the locking element 10 moving through the slot 26. When an attempt is made to pivot the legs in the opposite direction, so as to increase the gape size, the locking element 10, however, will be squeezed firmly in the slot, as a result of the action of the spring 23, and therewith prevent opening of the jaws. The jaws cannot be opened, until the locking arm 21 is pivoted slightly against the action of the spring 23. As an alternative to spring 23, the locking arm 21 may be activated manually or gravitationally when the tool is in use, so as to adopt the latching position illustrated in FIG. 6.

Figure 8:
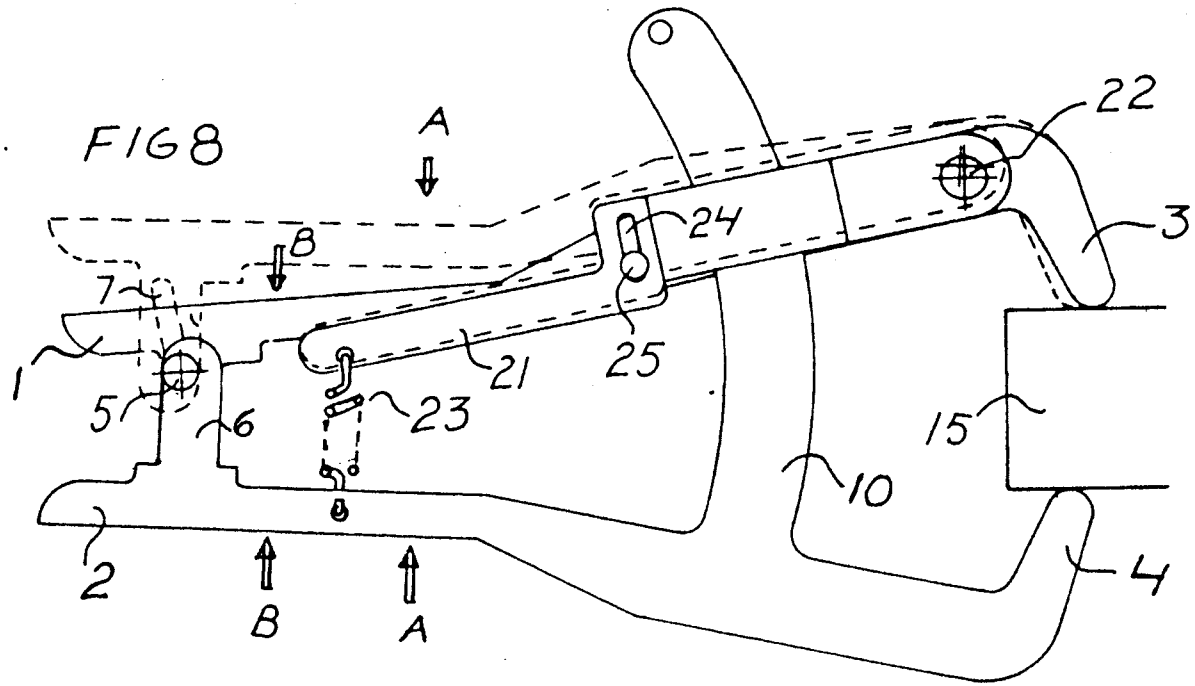
FIG. 8 illustrates the tool according to FIG. 6 in engagement with the workpiece.

The modus operandi of the tool illustrated in FIG. 6 and 7 is shown in FIG. 8, wherein, similarly to the FIG. 3 embodiment, the upper leg 1 is shown in broken lines in the position adopted by the leg when the legs 1 and 2 are pivoted into engagement with the workpiece 15 with the aid of forces acting in the directions of the arrows A, without appreciable compression of the spring 9. The legs are then activated with forces acting in the directions of the arrows B, so as to compress the spring 9 (not shown in FIG. 8). When the external forces acting on the legs are removed, the upper leg 1 will be locked firmly relative to the lower leg 2, as a result of the action of the spring 23 on the locking arm 21, which causes the locking element 10 to be clamped firmly in the slot 26 in the event of the leg 1 being urged upwards by the spring 9.

Thus, with this embodiment, the pivot point between the two legs 1 and 2 has been moved, with the aid of the locking arm 21, to the position of the pivot in 22, which is located very close to the jaw 3. Consequently, the length ratio L1/L2 described with reference to FIG. 1 will be very large, which results in correspondingly large amplification of the pressure force exerted by the spring 9 between the jaws 3 and 4. A ninefold amplification can be readily achieved in practice.

The tool is released from the workpiece, by pressing up the locking arm 21 against the action of the spring 23, wherewith the legs 1 and 2 can be swung away from one another. If desired, a further lever arm mechanism can be used for swinging the arm 21 upwards, so as to minimize the force required herefor.

FIG. 9 illustrates an embodiment of an inventive hand tool which is configured from one piece of material and which may comprise an extruded, rod-like aluminium profile or section, or a compression moulded plastic profile. When the tool is made of aluminium, it can be used as a contact clamp or clip to conduct electric currents, and can be used for extremely large currents without the spring characteristic being impaired. In this respect, the tool can be used as an earthing clamp for instance, in conjunction with electric welding work. When the clamp, or tool, is a one-piece structure, there will be no transission resistances.

In the case of this embodiment, the substantially rigid legs 27 and 28 with respective jaws 29 and 30 merge with a common rear part 31 which functions as a compressible leaf spring and which also serves as a gripping part. In this case, the locking device comprises a toothed element 32, which is arched outwardly from the leg 28, and a latching pawl 33 which projects out from the leg 27 for coaction with the arcuate toothed locking element 32. The reference 34 identifies a hole provided in an outwardly projecting flange part and intended to receive a connecting device located on an electrical contact cable. This hole, however, may be replaced with a connector profile 42 formed integerally with the clamp or tool; see FIGS. 11–13.

When the tool is not in use, the spring 31 holds the jaws 29 and 30 slightly apart. The tool, however, can be used to clamp workpieces whose thicknesses differ with respect to this spacing. The gape between the jaws 29 and 30 can be enlarged, by manually exerting on the gripping part squeezing forces which act in the direction of the arrows D. This will cause the legs 27 and 28 with respective jaws 29 and 30 to be swung away from one another, about the geometric pivot centre E of the spring 31. If it is assumed that the lower part of the spring which merges with the leg 28 is held stationary, the jaw 29 will be swung upwards in the direction of the arrow $F_1$ to the upper position shown in broken lines. Similarly, the latching pawl 33 will be swung upwards in the direction of the arrow $G_1$, to the upper broken-line position. This pivotal movement of the legs thus occurs around the point E without appreciable compression of the spring 31, and consequently substantially the whole spring length of the spring remains, even subsequent to such pivotal movement.

If the clamp, or tool, is to be applied onto a workpiece which is thinner than the distance between the jaws 29 and 30, the workman will exert forces in the directions of the arrows H, these forces causing the jaws and the latching pawl to pivot in respective direction $F_2$ and $G_2$ to their lower positions illustrated in broken lines. This movement is also effected by pivoting of the legs about the point E in the absence of appreciable compression of the spring 31.

Figure 10:
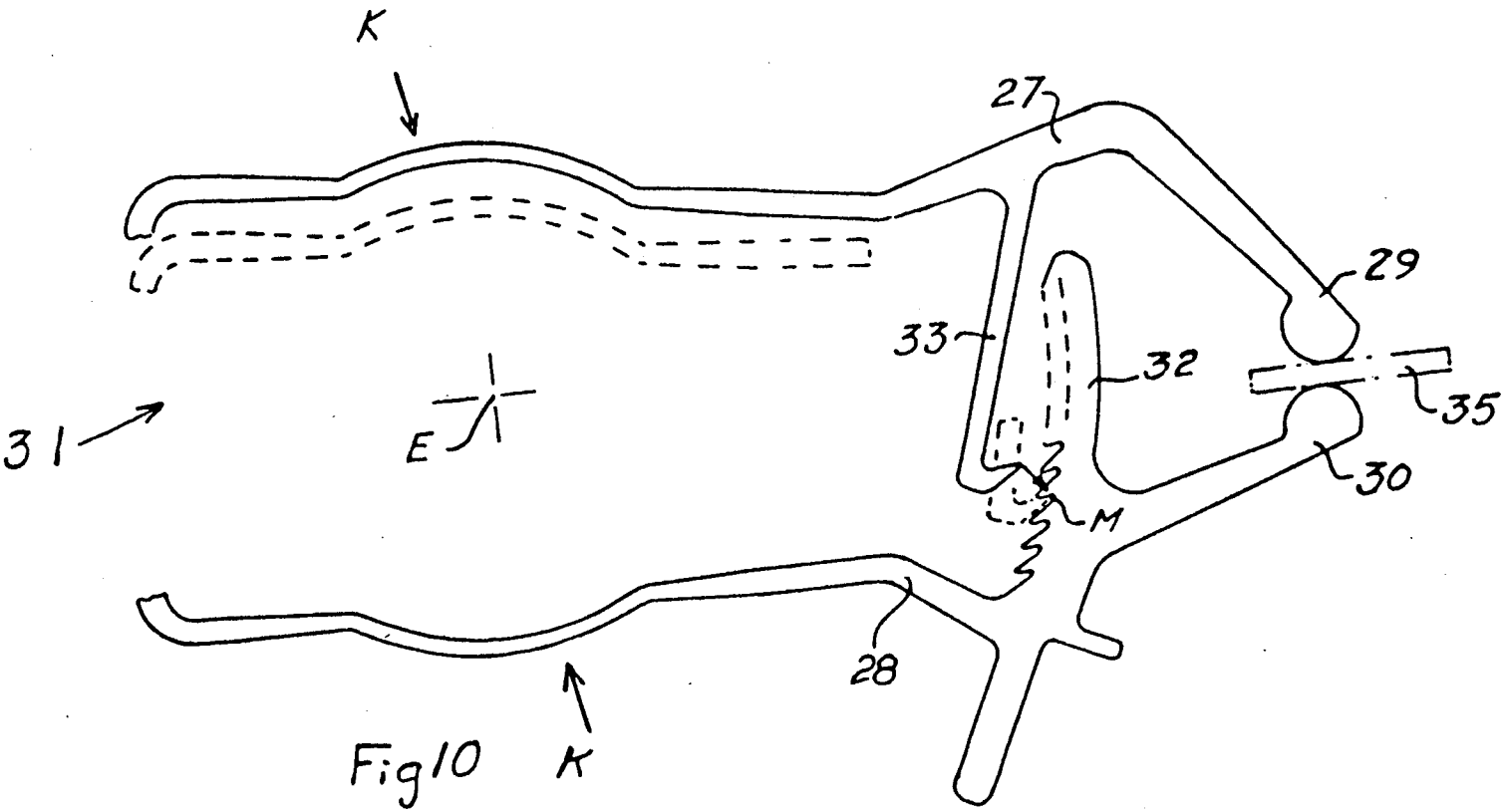
FIG. 10 shows the clamp of FIG. 9 in engagement with the workpiece.

Subsequent to opening or closing the jaws 29 and 30 for engagement with a workpiece, the spring 31 is compressed and locked in a compressed state for the purpose of generating desired clamp force on said workpiece. This is illustrated in FIG. 10 in connection with a relatively thin workpiece 35, which is gripped between the jaws 29 and 30 by exerting on the clamp forces which act in the directions of the arrows H in FIG. 9. For the purpose of achieving desired compression, the legs of the spring 31 can then be pressed essentially parallel with one another to the broken-line position of the upper leg, and then displaced axially in relation to one another, so that the pawl 33 is brought into locking engagement with a locking tooth on the locking member 32, as illustrated in broken lines. The remaining part of the spring 31 of the FIG. 9 embodiment has not been shown in FIG. 10, for the sake of clarity.

In practice, the aforesaid squeezing together of the legs and longitudinal displacement thereof is effected in one single movement by applying forces on the legs in the direction of the arrows K. When these forces on the legs are subsequently removed, the locking pawl 33 is held in locking engagement by the frictional forces which occur at the contact surface between said pawl and the active locking tooth of the locking element 32.

In order to release the lock, the legs are pressed together parallel with one another, whereupon the pawl will normally be withdrawn from its locking engagement with said tooth, as a result of the action of said spring. Alternatively, this unlocking, leg squeezing action can be affected by allowing forces corresponding to the forces K in FIG. 10 to act along an opposite diagonal to that shown in FIG. 10, see FIG. 12.

As with the earlier case, the clamping force which acts on the workpiece in the working position of the tool is determined by the extent to which the spring 31 is compressed. When this compressive force on the spring is relieved, the point of engagement of the pawl 33 with the toothed locking element 32 will function as a moveable pivot point M, about which the legs tend to pivot under the separating force exerted by the spring 31. Because of the relatively short distance between the jaws 29 and 30 and the pivot point M, the spring force will thus be transmitted to the workpiece 35 in the form of an amplified clamping force. A threefold amplification can be readily achieved in practice. To avoid fracture of the spring 31, the spring is provided with compression limiting projections 36 and 37, which restrict the extent to which the spring can be compressed, as illustrated in FIG. 9.

Figure 11:
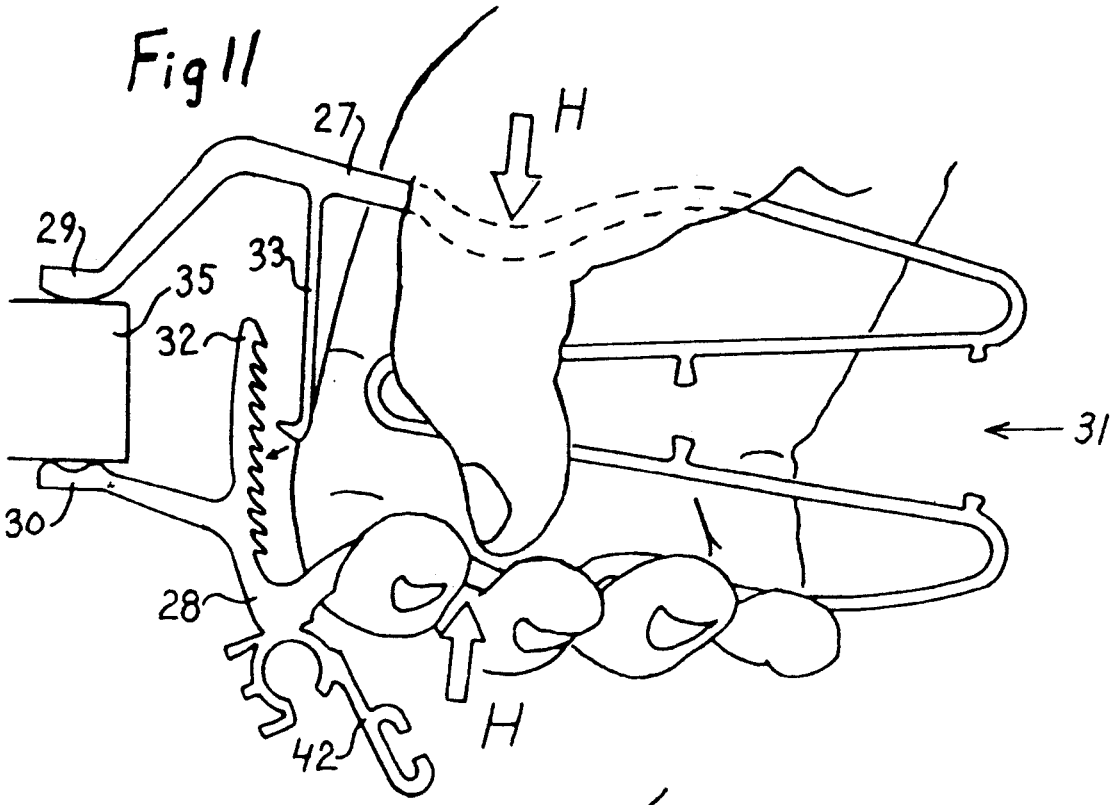
FIGS. 11 and 12 illustrate manipulation of a clamp of the kind illustrated in FIG. 9.
Figure 12:
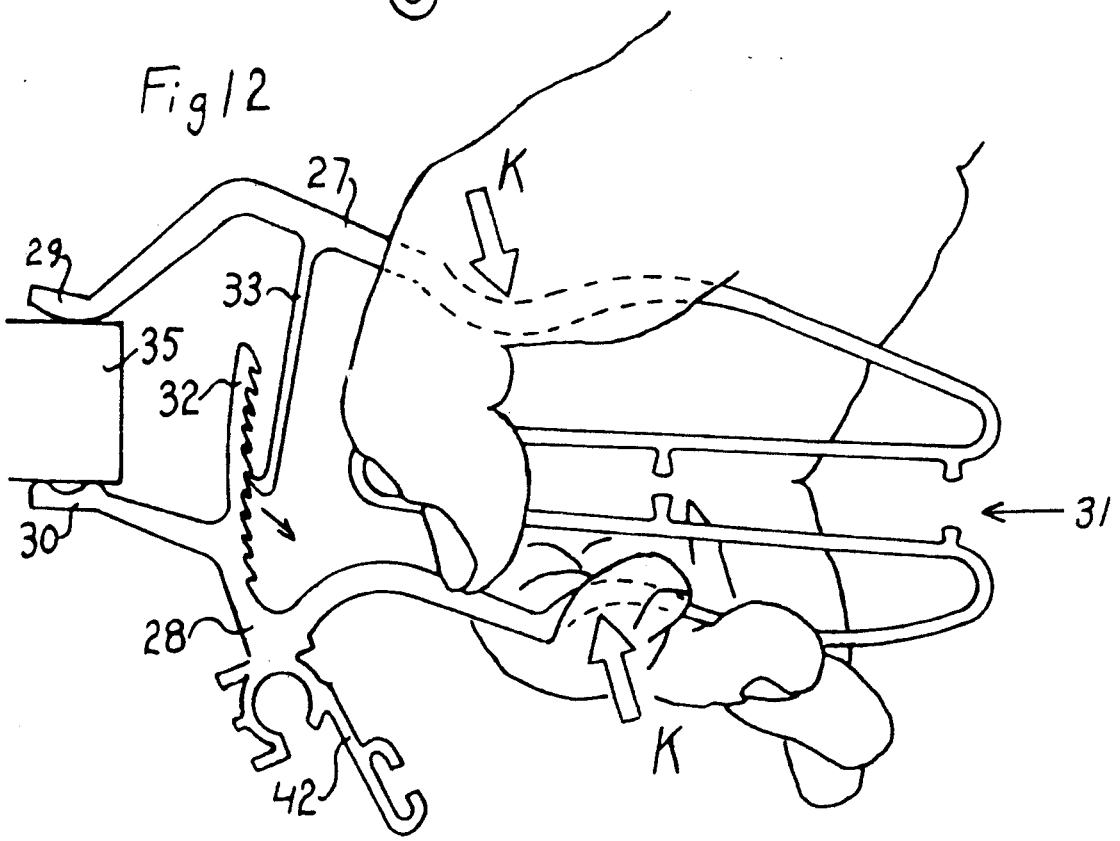

The hand grips or hand positions, which need to be accomplished in accordance with the above, in order to apply the clamp to or remove the clamp from a workpiece, are illustrated schematically in FIGS. 11 and 12 respectively.

Figure 13:
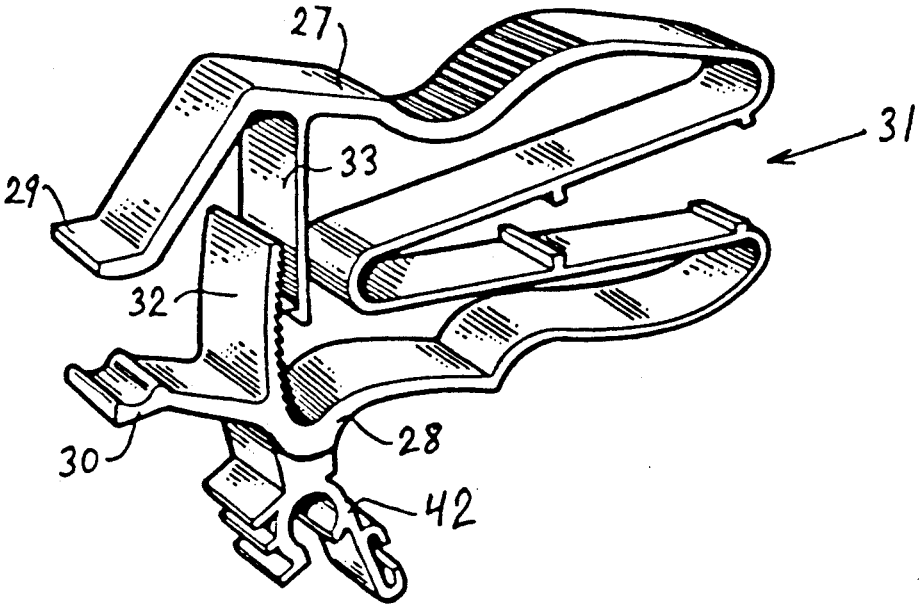
FIG. 13 is a perspective view of the clamp illustrated in FIGS. 11 and 12.

When the width and height ratio of the leaf spring permits, the spring may be relatively rigid laterally, but will always exhibit requisite flexibility in other respects required for satisfactory functioning of the spring and to permit the relative axial movement between the legs. A preferred embodiment is illustrated in FIG. 13.

A favourable material from the aspect of electrical applications is an aluminium alloy, with which it is possible to achieve the desired combination of low resistivity, low elasticity modulus, high yield point and low volume price. In this respect, it is possible in practice to provide a clamp which is capable in its entirety of conducting large currents in the absence of deleterious heating of the tool and while providing the desired spring characteristics. One particularly favourable advantage in this respect is that clamps of mutually different sizes can be readily manufactured, by cutting suitable lengths from an extruded aluminium profile section. With respect to the well-being of the workman, the clamp, or tool, should have a largest width in the order of 35 mm. Thus, clamps capable of exerting mutually different clamping forces can be cut from the same extruded section, and, similarly, clamps for different current ratings can be manufactured, in the case of tools intended for work with electrical equipment.

The requisite, inventive locking of the legs 2 and 3 relative to one another in the working position of said legs can also be achieved in a manner different to that illustrated in FIG. 10, FIGS. 14 and 15 illustrate an alternative embodiment of an inventive clamp. Only the differences between this clamp and the clamp according to the embodiment of FIGS. 9 and 10 will be described. FIG. 14 also shows only parts of the blade spring.

In the case of the clamp according to FIGS. 14 and 15, it is not necessary to provide for longitudinal displacement between the legs 27 and 28, and hence compression of the spring 31 when tensioning said spring can be effected with the aid of forces O acting vertically in the figure. In this case, locking of the legs is effected with the aid of a spring rod or wire 38, which is mounted in a locking element 39 projecting down from the leg 27, such that a stirrup-like part 40 of the wire rod, which part engages around a locking element 41 projecting up from the leg 28, will be tensioned in a downward direction along said element. When the forces O which compress the spring 31 are removed, the stirrup-like part 40 of the spring rod 38 will be squeezed and, as a result of friction forces, firmly lock the locking elements 39 and 40 in the adopted position relative to one another.

The locking engagement is released by application of a force, suitably with the thumb, on the spring rod 38 in the direction of the arrow P, so that the bent part of the wire rod 38 will move downwards in the direction of the arrow R, while the stirrup-like part 40 moves upwards along the locking member 41 in the direction of the arrow S. This will release said locking engagement.

FIGS. 16 and 17 illustrate an alternative embodiment of the locking mechanism of the clamp shown in FIG. 14. In this case, there is used a spring rod 43 which is bent in one plane and which is mounted in slots in an excentric element 44, such as to strive to rotate the excentric element in the direction of the arrow T, i.e. to a locking position. When the jaws 29 and 30 move towards one another, frictional forces release the locking effect of the excentric element 44. If, on the other hand, an attempt is made to open the jaws, the frictional forces will tend to rotate the excentric element in said locking direction. The lock is released by manipulating a lever arm 45 connected to the excentric element, with a force acting in the direction of the arrow U.

The invention has been described in the aforegoing with reference to embodiments thereof illustrated in the accompanying drawings. These embodiments, however, can be modified in several respects within the scope of the following claims. For instance, the configuration of the spring 31 illustrated in FIG. 9 can be varied as desired, wherewith if a shorter spring is required the spring can be configured with a multiple of convolutions or windings. Furthermore, in the case of the embodiments illustrated in FIGS. 6–8, when the tool is at rest the legs can be made freely pivotable for opening and closing of the legs, by reducing the height of the slot 24. Locking in this case will not occur until the legs are pressed together. The jaws of the illustrated clamp are slightly open in the inactive state of the tool. Alternatively, the jaws may be closed and first opened when a force is applied, which can be an advantage when the workpiece involved is very thin.

The profile section used as starting material in the manufacture of clamps according to FIG. 9 is preferably extruded with a relatively large angle between the spring legs. These are then rolled together, to form a profile according to FIG. 9. If found convenient for manufacturing reasons, two separate profile sections can be extruded and then joined together to form the profile of FIG. 9.

In order to avoid the risk of elevated contact resistance, as a result of aluminium oxide coatings on the contact surfaces of the jaws, these surfaces can be coated with another suitable contact material. Alternatively, pieces of material functioning as contact bodies can be pressed into slot-like openings in the contact surfaces.

In order to widen the range of use of the inventive tool, a clamp constructed in accordance with the invention can be configured in a manner which will enable the jaws to be exchanged with jaws having, for instance, other configurations or angles.

I claim:

1. A hand tool for lockably applying a squeezing or separating force to a workpiece (15; 35), comprising two legs (1, 2; 27, 28) which can be pivoted relative to one another and one end of which legs is free and forms a respective one of two jaws (3, 4; 29, 30) intended for co-action with said workpiece, and which legs are mutually joined at a distance from said one ends by means of a spring element (9; 31), characterized in that the spring element (9; 31) has an effect which corresponds to a compressible pressure spring; in that the legs (1, 2; 27, 38) are rigid and adapted for pivotal movement relative to one another such as to bring the jaws into contact with the workpiece (15; 35) without appreciably compressing the spring element; in that a locking device (10, 12, 13; 21, 26; 32, 33, 38, 41) is arranged between said spring element and said jaws, said locking device being intended, subsequent to desired compression of the spring element (9; 31) with the jaws (3, 4; 29, 39) in contact with the workpiece (15; 35), to releasably lock the position of a pivot between the legs; and in that said pivot is located at a shorter distance from the jaws than from the action line of the spring element, so that the force exerted by the spring element will give rise to an amplified pressure force on the workpiece.

2. A hand tool according to claim 1, characterized in that the spring element is a pressure spring (9;31) which is so configured or arranged as to permit desired relative pivoting movement of the legs (1, 2; 27, 28) and in that the locking device includes a locking element (10; 32; 41) which projects out from the first leg (2; 28) and which is intended to co-act with a locking member (13; 21; 26; 33; 38) on the other leg (1; 27) such as to lock the legs relative to one another while forming a pivot means between said legs.

3. A hand tool according to claim 2, characterized in that said locking element (10; 32) has a toothed section; and in that said locking member includes a latching pawl (13; 33) which is intended to engage said toothed section.

4. A hand tool according to claim 2, characterized in that said locking member includes an excentric mechanism (16, 18) intended for co-action with said locking element (10).

5. A hand tool according to claim 2, characterized in that said locking member includes a locking arm (21); in that the arm is pivotally mounted at its forwardly located end on said second leg (1), close to the jaw (3) on said leg; in that the arm extends along said leg; and in that said arm is intended to co-act with said locking element (10) in a manner to permit the legs to be pivoted towards each other but to prevent pivoting of the legs in the opposite direction unless a latching mechanism (21, 26) has been released.

6. A hand tool according to claim 5, characterized in that the locking arm (21) is spring biassed in a direction towards said first leg (2) and has provided therein a slot or groove (26) which receives said locking element (10) and in that the slot and the locking element are so configured that the locking element can move freely in one direction in the slot but is locked against movement in the opposite direction unless the arm (21) is pivoted slightly against the action of said spring (23).

7. A hand tool according to any one of claims 1–6, characterized in that said spring element comprises a compressible leaf spring (31), which also functions as a pivot means when said legs (27, 28) are pivoted into abutment with the workpiece (35).

8. A hand tool according to claim 7, characterized in that at least the spring element (30) and said legs (27, 28) have the form of a single-piece structure.

9. A handle tool according to claim 8, particularly intended for use as a contact clip or clamp for connection of electric current, characterized in that the tool comprises part of an extruded, rod-like profile section made of a material having good electrical conductive properties, such as aluminium.

10. A hand tool according to claim 7, characterized in that the leaf spring (31) connecting the legs (27, 28) includes at least one part which projects in between the legs, and in that the distance between said jaws (29, 30) can be increased by pressing together the ends of the legs remote from the jaws.

* * * * *